US005672096A

United States Patent [19]

Amarosa, Sr. et al.

[11] Patent Number: 5,672,096

[45] Date of Patent: Sep. 30, 1997

[54] INFLATABLE TOOL

[75] Inventors: Robert P. Amarosa, Sr., Durham; Peter J. Amarosa, Greenland, both of N.H.

[73] Assignee: R. P. Abrasives & Machine, Inc., Rochester, N.H.

[21] Appl. No.: 652,326

[22] Filed: May 22, 1996

[51] Int. Cl.[6] ..... B24B 9/02

[52] U.S. Cl. ..... 451/504; 451/505; 451/506; 451/507

[58] Field of Search ..... 451/504–507

[56] References Cited

U.S. PATENT DOCUMENTS

| | | | |
|---|---|---|---|
| 1,045,201 | 11/1912 | Shoop . | |
| 1,948,643 | 2/1934 | Bertrand | 51/194 |
| 2,225,073 | 12/1940 | Miller | 51/192 |
| 2,323,962 | 7/1943 | Ames | 51/192 |
| 2,483,278 | 9/1949 | Hamilton | 51/192 |
| 2,601,048 | 6/1952 | Monger | 51/192 |
| 2,605,594 | 8/1952 | Macdonell | 451/505 |
| 3,166,876 | 1/1965 | Manchester | 451/507 |
| 3,178,863 | 4/1965 | Mikiya | 451/505 |
| 3,203,073 | 8/1965 | Stein | 29/113 |
| 3,221,449 | 12/1965 | Lewis et al. | 51/373 |
| 3,232,011 | 2/1966 | Pineau | 51/373 |
| 3,253,323 | 5/1966 | Sauressig | 451/505 |
| 3,319,686 | 5/1967 | Prevette | 150/52 |
| 3,362,113 | 1/1968 | Feather | 451/505 |
| 3,848,374 | 11/1974 | Hasegawa | 51/373 |
| 4,897,968 | 2/1990 | Hutt | 51/373 |
| 5,351,447 | 10/1994 | Grauert | 451/505 |

OTHER PUBLICATIONS

Nu–Matic Grinders, Inc. Cleveland, OH —4 page brochure dated Nov. 1, 1994 Ekstrom, Carlson & Co., Rockford, IL —Pneumatic Drum Sanders —4 pg catalog No. PS–8.

*Primary Examiner*—Robert A. Rose
*Assistant Examiner*—George Nguyen
*Attorney, Agent, or Firm*—Daniel J. Bourque; Kevin J. Carroll

[57] ABSTRACT

An inflatable tool is used for abrading or finishing a surface of a workpiece. The inflatable tool includes an inflatable bladder clamped at first and second ends of a core having an elastomeric outer core portion. The inflatable bladder is inflated by a pressurized medium and forms a pocket or chamber around the elastomeric outer core portion. An abrasive sleeve is disposed around and secured by the inflatable bladder when inflated. The elastomeric outer core portion provides a resilient support surface for the inflatable bladder and the abrasive sleeve while abrading a workpiece. One example of the abrasive sleeve includes one or more bulging abrasive regions created by one or more slots in the abrasive sleeve. One example of a method of using the inflatable tool includes abrading a surface of a workpiece with one or more bulging abrasive regions, and chamfering both sides of a hole extending through a workpiece.

23 Claims, 5 Drawing Sheets

INFLATABLE TOOL

FIELD OF THE INVENTION

The present invention relates to inflatable tools and in particular, to an inflatable tool having an elastomeric core and a bulging abrasive sleeve and a method of using such an inflatable tool to abrade surfaces of a workpiece.

BACKGROUND OF THE INVENTION

Inflatable tools have been used for abrading or finishing workpiece surfaces, such as by sanding, grinding, buffing, and polishing. Inflatable tools typically provide a flexible abrading surface that is preferred over rigid abrading surfaces. For example, rigid abrading surfaces often cause vibrating or chattering of the tool and workpiece, thereby causing damage to the tool and the workpiece, particularly when the workpiece surface is uneven. An inflatable tool provides a flexible abrading surface that yields to the workpiece surface to avoid chattering and damaging the workpiece surface.

Prior art inflatable tools, however, have not sufficiently met the needs of different types of abrading and machining and difference sizes and shapes of workpieces. One problem with many of the prior art inflatable tools is that they are overly complex and are limited in size. Such devices are also expensive to manufacture, difficult to use, and are limited in their use. Many prior art inflatable tools, for example, are not capable of being used to abrade or polish relatively small internal surfaces in a workpiece. The complex structure of many prior art inflatable tools does not permit the tools to be easily manufactured in a variety of sizes.

Another problem with prior art inflatable tools is that the inflatable abrading surface and the surface being abraded are often easily damaged. Prior art inflatable tools typically have a rigid surface beneath the inflatable abrading surface that causes damage to the inflatable abrading surface and the workpiece when the inflatable abrading surface is forced against the workpiece.

A further deficiency of the prior art is the limited shapes of the flexible abrading surface. The prior art inflatable tools provide only a substantially cylindrical abrading surface that has limited abrading applications.

Accordingly, what is needed is an inflatable tool having a relatively simple construction that is capable of being manufactured in a variety of sizes and that is capable of being used for abrading or finishing a variety of sizes and types of surfaces in or on a workpiece. An inflatable tool is also needed that provides a flexible support surface for the inflatable abrading surface to prevent damage to the inflatable abrading surface. Finally, an inflatable abrasive surface is needed that can be inflated to various sizes and shapes and used for various applications.

SUMMARY OF THE INVENTION

The present invention features an inflatable tool that comprises a core including an inner core portion and an elastomeric outer core portion disposed over the inner core portion. An inflatable bladder is disposed over the core and sealably fixed at a first core end and a second core end such that a chamber or pocket forms between the inflatable bladder and the elastomeric outer core portion in an inflated state.

According to a preferred embodiment, the inflatable tool further includes a first end clamping plate for sealably clamping the inflatable bladder to the first core end and a second end clamping plate for sealably clamping the inflatable bladder to the second core end. Each of the first end clamping plate and second end clamping plate include an angled clamping region against which respective first and second ends of the inflatable bladder are clamped. The inflatable tool further includes first and second engaging members for engaging with the inner core portion of the core and for securing the first end clamping plate and second end clamping plate against first and second ends of the inflatable bladder at the first core end and second core end respectively. An abrasive sleeve is preferably disposed around and secured by the inflatable bladder when the inflatable bladder is in the inflated state.

The preferred embodiment of the inflatable tool further includes a passageway extending through the inner core portion and the outer elastomeric core portion, for allowing a pressurized medium to pass through the inner core portion and elastomeric outer core portion to inflate the inflatable bladder. A valve is operably coupled to the passageway, for allowing the pressurized medium to pass into the passageway. A first end of the valve includes a valve passageway and is threadably coupled within the inner core portion such that the valve passageway communicates with the passageway in the core. A second end of the valve includes a coupling region, for coupling to an inflating device.

The present invention also features an inflatable tool that comprises a core having at least one passageway extending through a central region of the core. A rubber bladder is sealably fixed at a first core end and a second core end such that a pocket forms between the rubber bladder and the core in an inflated state when a pressurized medium passes through at least one passageway extending through the core. At least one bulging abrasive region is formed on the rubber bladder when in the inflated state.

According to a preferred embodiment, an abrasive sleeve is disposed around and secured by the rubber bladder and forms one or more bulging abrasive regions when the rubber bladder is in the inflated state. The abrasive sleeve preferably includes at least one slot extending substantially longitudinally in at least a portion of the abrasive sleeve to allow the rubber bladder to form the bulging abrasive region when the inflatable tool is inflated. The rubber bladder is preferably made of a non-molded rubber material.

The present invention also features an abrasive sleeve for use on an inflatable tool to abrade a surface of a workpiece. The abrasive sleeve comprises a sleeve portion for positioning on the inflatable tool and includes an abrasive region for abrading the surface of the workpiece. At least one slot extends substantially longitudinally in at least a portion of the sleeve portion for allowing that portion of the sleeve portion to bulge when the inflatable bladder is inflated.

According to one embodiment, the abrasive sleeve includes a series of substantially parallel slots extending substantially longitudinally in the sleeve portion and circumferentially spaced around the sleeve portion such that the series of slots create a bulging abrasive region around the sleeve portion. According to another embodiment, the abrasive sleeve includes at least a first and second series of substantially parallel slots extending substantially longitudinally in at least first and second portions of the sleeve portion respectively such that the first and second series of slots create at least first and second bulging abrasive regions respectively.

The present invention also features a method for abrading a surface of a workpiece. The method includes the steps of:

providing an inflatable tool having an inflatable tool surface; inflating the inflatable tool surface and creating at least one bulging abrasive region on the inflatable tool surface; rotating the inflatable tool surface; and abrading a surface of the workpiece with the bulging abrasive region of the inflatable tool surface.

According to one method, the step of abrading a surface of a workpiece includes deburring an opening to an internal region of the workpiece with the bulging abrasive region. According to another method, the step of abrading includes using the bulging abrasive region to debur an intersection of an internal surface and at least one perpendicular hole drilled into the workpiece. According to a further method, the step of abrading includes simultaneously abrading both sides of a hole extending through a workpiece with first and second bulging abrasive regions respectively.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
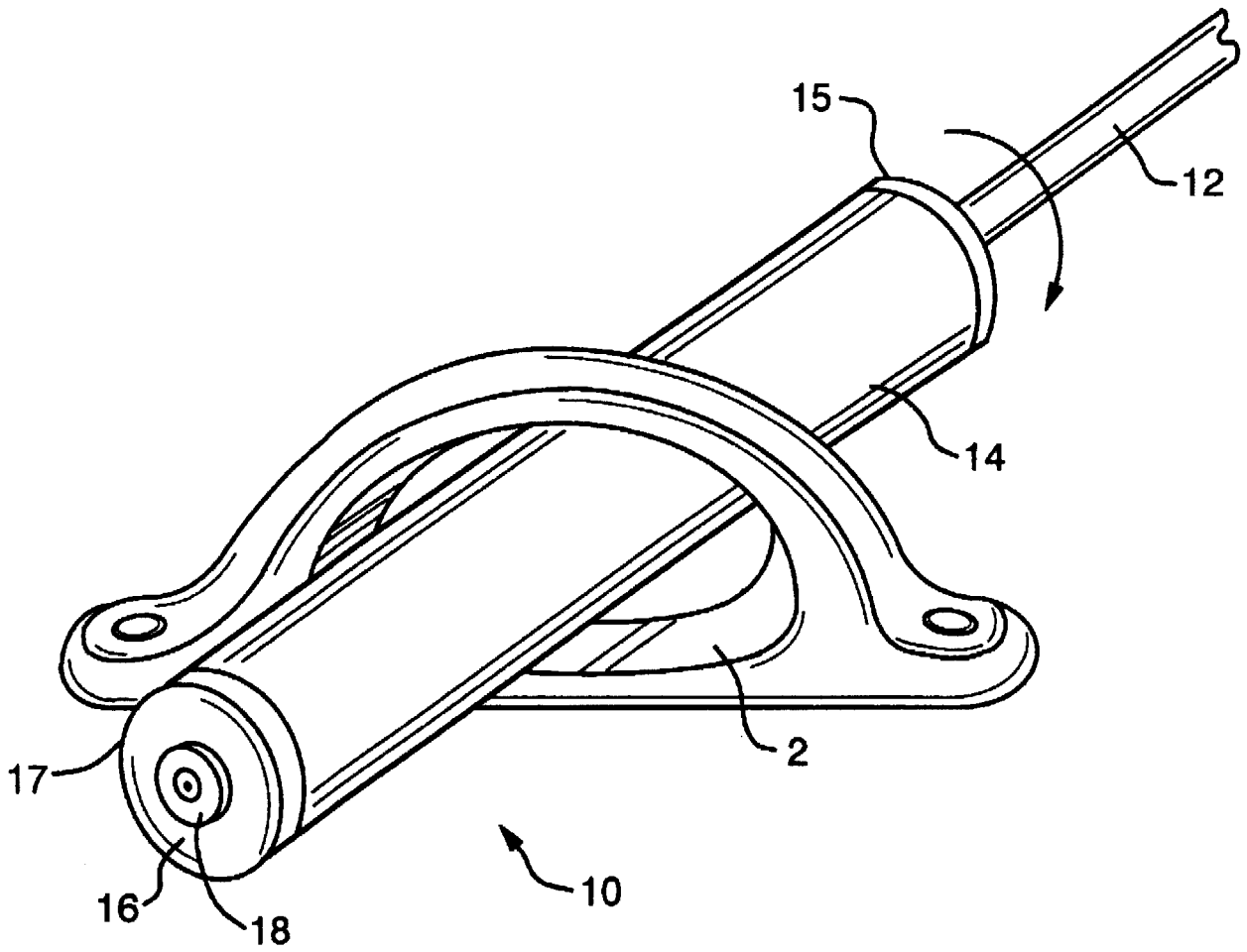
FIG. 1 is a perspective view of an inflatable tool, according to the present invention, being used to abrade an internal surface of a workpiece.

An inflatable tool 10, FIG. 1, according to the present invention may be used for machining or preparing a workpiece surface 2. According to the exemplary embodiment, the inflatable tool 10 is used for abrading the surface of a workpiece. Abrading includes, but is not limited to, grinding, honing, deburring, sanding, buffing, polishing, finishing, and chamfering. The present invention contemplates using the inflatable tool 10 with any type of machining or other process for preparing a workpiece surface, either external or internal, that is either flat or irregular.

The inflatable tool 10 is rotatably driven about its longitudinal axis by a machine tool (not shown) such as a drill, air driven rotator, CNC machine or the like. For example, a shank 12 of the inflatable tool 10 is secured in a chuck or other similar tool holder of the machine tool. The present invention contemplates rotatably driving the inflatable tool 10, for example, with a drill press, lathe, milling machine, hand-drill, air tool and any other rotatably driven machine tool. The inflatable tool is typically rotated up to 5000 RPM, but the present invention contemplates any suitable speed of rotation.

The inflatable tool 10 includes an inflatable tool surface 14, such as an abrasive surface, or any other type of workpiece altering surface used for grinding, deburring, honing, sanding, polishing, buffing, chamfering, finishing or otherwise preparing a workpiece surface. The inflatable tool 10 also includes a core 16 that supports the inflatable tool surface 14 and about which the inflatable tool surface 14 expands. The shank 12 is preferably coupled to a first core end 15 of the core 16. In one embodiment, a valve 18 is operatively coupled proximate a second core end 17 of the core 16, as will be described in greater detail below.

Figure 2:
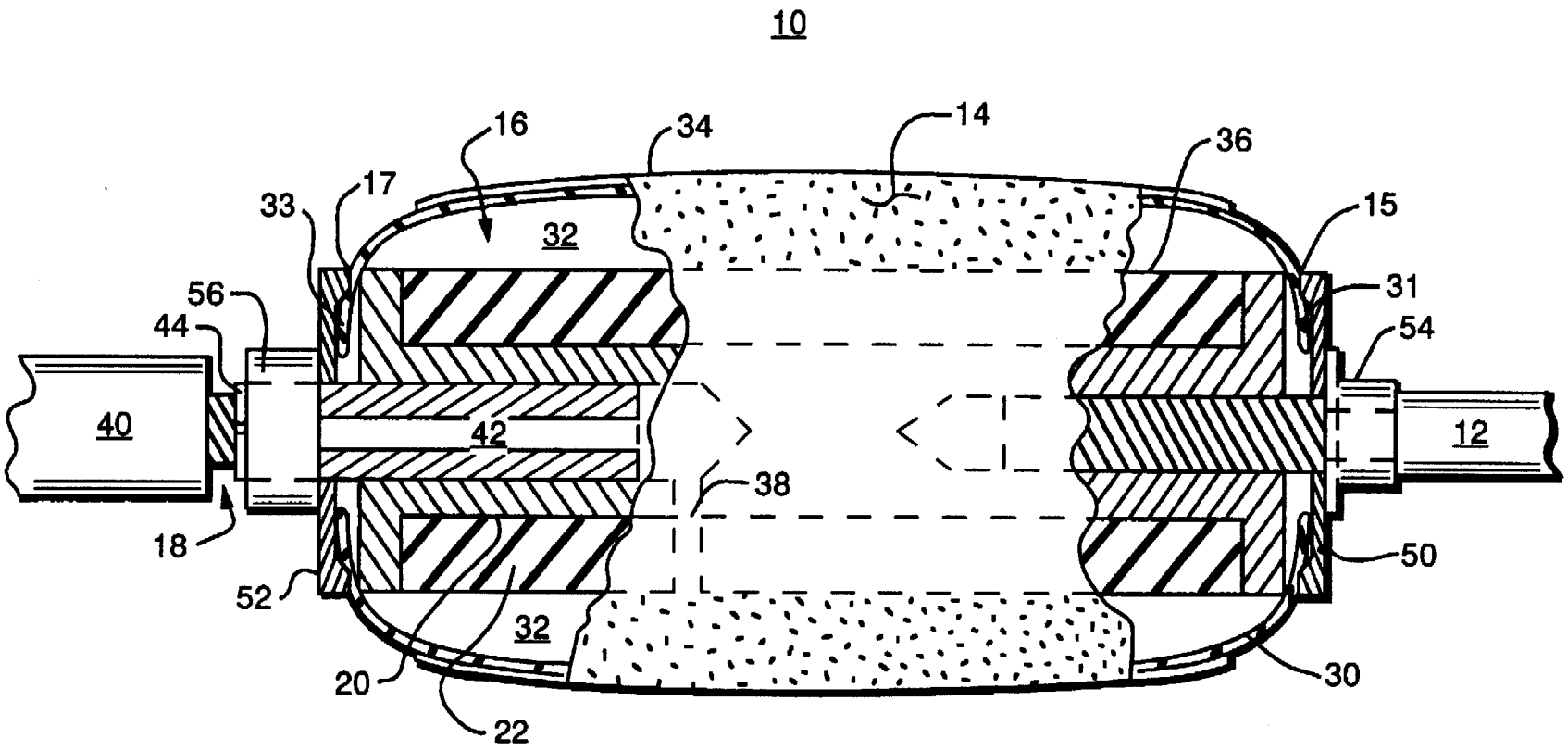
FIG. 2 is a partial cross-sectional view of an inflatable tool according to one embodiment of the present invention.

According to a preferred embodiment, the inflatable tool 10, FIG. 2, includes a core 16 comprising an inner core portion 20 and an elastomeric outer core portion 22 disposed around the inner core portion 20. The inner core portion 20 is preferably made of a steel, such as cold roll-12L14-1018, or any other metal or suitable rigid materials.

The inflatable tool 10 further includes an inflatable member or bladder 30 sealably fixed or clamped to the first core end 15 and the second core end 17. In an inflated state, a chamber or pocket 32 containing a pressurized medium, such as air, water, gel, or the like, exists between the inflatable bladder 30 and the elastomeric outer core portion 22 of core 16. The inflatable bladder 30 disposed around the elastomeric outer core portion 22 is preferably made of a non-molded rubber material that allows the inflatable bladder 30 to be easily inflated. The inflatable bladder 30 is preferably in the range of 0.020 to 0.060 inches thick and in one example, is approximately 0.040 inches thick.

The inflatable tool surface 14 is preferably provided by an abrasive sleeve 34 disposed around the inflatable bladder 30 and held in place by the inflatable bladder 30 when inflated. Abrasive sleeves 34, as used herein include, but are not limited to, any sleeve or belt used for sanding, grinding, buffing, polishing, honing, finishing, or any type of workpiece surface preparation. When the inflatable abrasive surface 14 contacts a workpiece surface (not shown), the pocket or chamber 32 allows the inflatable tool surface 14 to yield or deform to conform to the workpiece surface.

The elastomeric outer core portion 22 of core 16 provides a resilient surface 36 behind the inflatable tool surface 14. In a deflated state, the inflatable bladder 30 preferably lies against the resilient surface 36 of the elastomeric outer core portion 22. If the inflatable tool surface 14 is forced against a workpiece, for example, the resilient surface 36 on the elastomeric outer core portion 22 will provide a cushion and prevent damage to the workpiece, the inflatable bladder 30, and the inflatable tool surface 14, such as abrasive sleeve 34. The elastomeric outer core portion 22 is preferably made out of rubber, such as a vulcanized rubber of about 40 to 45 Durometer, or any other suitable elastomeric material. In some examples, the thickness of the elastomeric outer core portion 22 is in the range of approximately 0.2 to 1 inches, but the present invention contemplates various possible thicknesses depending upon the desired usage, the desired outside diameter of the tool and the size of the inner core.

A passageway 38 preferably extends through the inner core portion 20 and elastomeric outer core portion 22 so that the pressurized medium, such as air, can be provided to the pocket or chamber 32 to inflate the inflatable bladder 30. The valve 18 is coupled to an inflating device 40 that provides the pressurized medium through a valve passageway 42 in the valve 18. The valve passageway 42 is in fluid communication with the passageway 38 through the inner core portion 20 and elastomeric outer core portion 22. The valve 18 includes a coupling region 44 that operatively couples the valve 18 to the inflating device 40, for example, by threading the inflating device 40 into the valve coupling region 44. The inflating device 40 includes an air pump or compressor or any type of device that supplies a pressurized medium.

The width and amount of cushion provided by the pocket or chamber 32 can be adjusted by varying the amount of pressurized medium, for example, within the range of about 0.02 to 0.4 inches wide. Varying the inflation thereby adjusts the diameter of the inflatable tool 10 and allows the abrasive sleeve 34 to be removed and replaced. The inflation and width of the chamber 32 can be varied to any degree depending upon the size of the inflatable tool and the desired application for the tool.

According to the preferred embodiment, the inflatable tool 10 includes a first end clamping plate 50 that sealably clamps a first end 31 of the inflatable bladder 30 to the first core end 15, and a second end clamping plate 52 that sealably clamps a second end 33 of the inflatable bladder 30 to the second core end 17. A first engaging member 54 secures the first end clamping plate 50 to the first core end 15. In one example, the first engaging member 54 is disposed at one end of the shank 12 and is threadably engaged within the inner core portion 20. A second engaging member 56 secures the second end clamping plate 52 against the second core end 17, for example, by threadably engaging with the valve 18 which is threadably engaged within the inner core portion 20.

Figure 3:
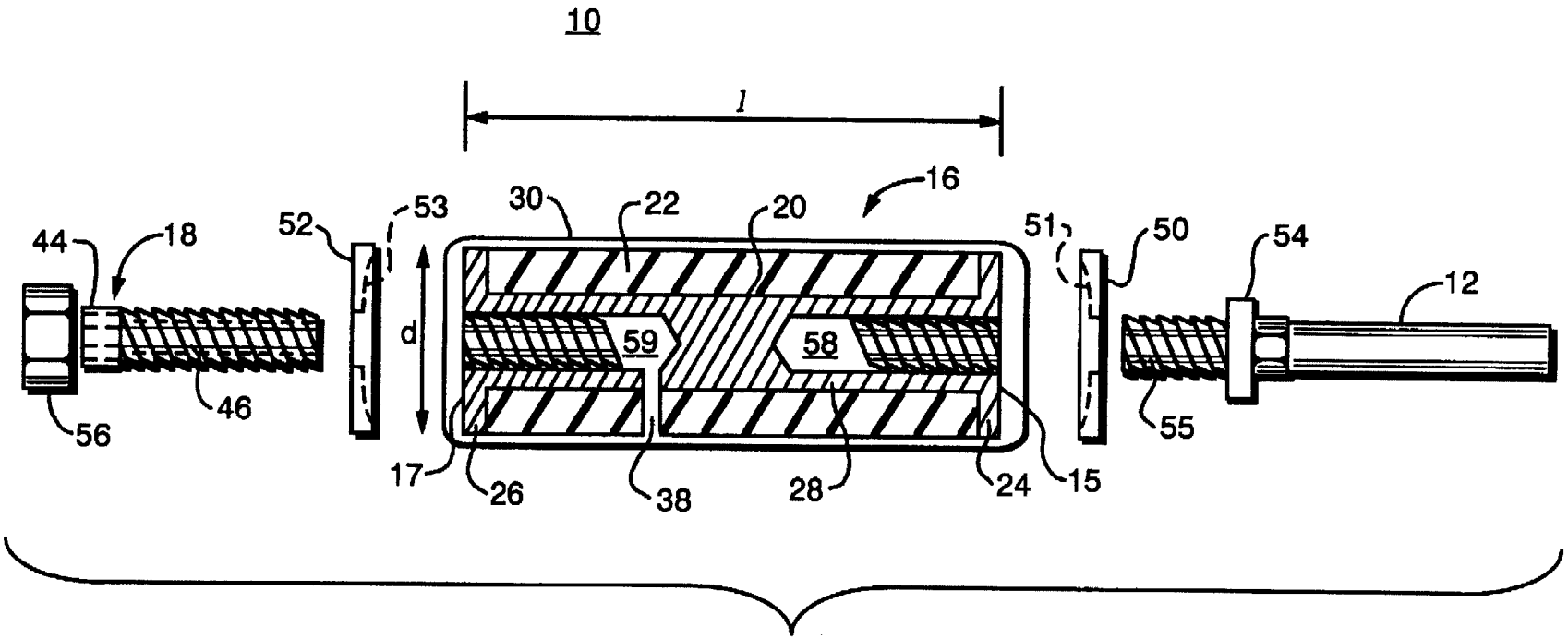
FIG. 3 is an exploded cross-sectional view of an inflatable tool according to the present invention.

The inflatable tool 10, FIG. 3, according to the preferred embodiment of the present invention has a relatively simple construction. The inner core portion 20 preferably includes flanges 24, 26 at the respective first core end 15 and second core end 17, and a central inner core region 28 extending between the flanges 24, 26. The central inner core region 28 preferably has a diameter or dimension that is smaller than that of the flanges 24, 26 so that the elastomeric outer core portion 22 extends around the central core region 28 between the flanges 24, 26. The exemplary embodiments include an inner core central region 28 having a cylindrical shape, but the present invention contemplates any possible shape.

The core 16 of the inflatable tool 10 can be manufactured in a wide range of dimensions, including a variety of lengths l and diameters d. The length l of the inner core portion 20 from the first core end 15 to the second core end 17 is typically in the range of approximately 1 to 12 inches, and in one example, is approximately 3 inches. The diameter d of the core 16 (or flanges 24, 26) is typically within the range of approximately ⅜ inches to 4 inches. The present invention, however, contemplates any possible length l and diameter d for the inflatable tool depending upon the intended application for the inflatable tool.

The preferred embodiment of each of the first and second end clamping plates 50, 52 includes an angled clamping region 51, 53 that receives a respective end of the inflatable bladder 30 and secures that respective end of the inflatable bladder 30 against the first core end 15 and second core end 17, respectively. The clamping plates 50, 52 also preferably have a diameter that matches that of the core 16 (or flanges 24, 26 of the inner core 18 portion 20) and are preferably made of a steel, such as cold roll-12L14-1018 steel, stainless steel, hard plastic, rubber, or other suitable material.

One example of the shank 12 includes a threaded end 55 that is threadably received in a first threaded region 58 within the inner core portion 20 at the first core end 15. When the threaded member 55 is threadably secured within the first threaded region 58 in the inner core portion 20, the first engaging member 54 secures the first end clamping plate 50 against the first core end 15 to sealably secure or clamp the inflatable bladder 30 at the first core end 15. The present invention also contemplates other suitable mechanisms for securing the first end clamping plate 50 and the shank 12 to the inner core portion 20 of the inflatable tool 10. The length of the shank 12 is typically within the range of 1 inch to 12 feet and the diameter is typically within the range of ¼ to 2 inches. The shank 12, however, can have any possible length and diameter depending on the desired application for the inflatable tool.

One example of the valve 18 includes a threaded valve end 46 that is threadably received in a second threaded region 59 within the inner core portion 20 at the second core end 17. The second engaging member 56 is threaded around the threaded valve end 46 of the valve 18 to clamp the second end clamping plate 52 against the second core end 17. The valve 18 is threaded into the second threaded region 59 such that the valve 18 is operatively coupled to and in fluid communication with the passageway 38. One example of the passageway 38 includes a hole drilled through the elastomeric outer core portion 22 and the inner core portion 20. The valve 18 also includes a coupling region 44 for coupling to an inflating device.

Figure 4:
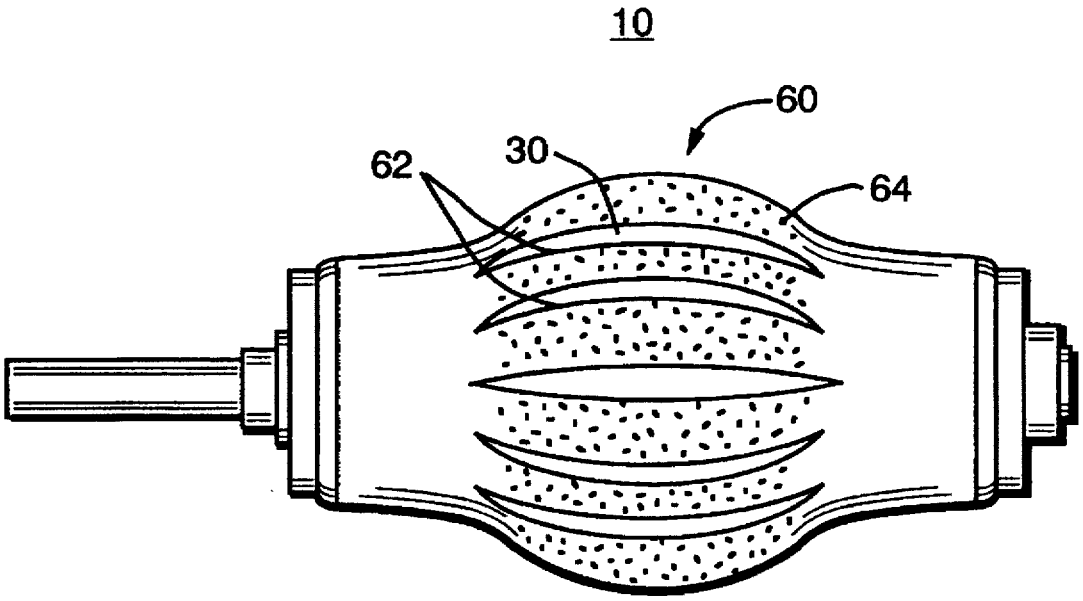
FIG. 4 is a side view of an inflatable tool having a bulging abrasive region according to another embodiment of the present invention.

According to another embodiment of the present invention, the inflatable tool 10, FIG. 4, includes one or more bulging abrasive or workpiece finishing regions 60. According to this embodiment, the inflatable bladder 30 is preferably made from a non-molded rubber material such as tire inner tube material that facilitates the bulging. The bulging abrasive region 60 is preferably created by providing one or more slots 62 in an abrasive sleeve 64. The slots 62 allow the inflatable bladder 30 to expand to a greater diameter, thereby creating the bulging abrasive region 60. The adhesive sleeve 64 having slots 62 can be used with the inflatable tool 10 as described above or with any type of inflatable tool.

Figure 5:
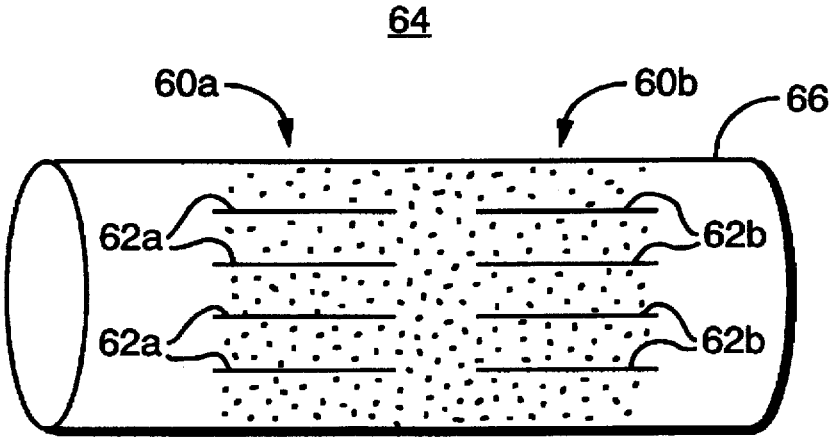
FIG. 5 is a side view of an abrasive sleeve according to one embodiment of the present invention.

An abrasive sleeve 64, FIG. 5, according to the present invention includes a sleeve portion 66 having one or more series of slots **62*a*, 62*b* extending substantially longitudinally in the sleeve portion 66 and circumferentially spaced around the sleeve portion 66. The slots 62*a*, 62*b* are preferably substantially straight, parallel and evenly distributed around the circumference of the sleeve portion 66, for example, at about 0.25 inches apart. Each series of slots 62*a*, 62*b* are also spaced longitudinally along the sleeve portion 66, e.g. about 1 inch, to form first and second bulging abrasive regions 60*a*, 60*b*, when the inflatable tool 10** is inflated. The present invention contemplates any number of bulging abrasive regions in the abrasive sleeve as desired.

One example of the abrasive sleeve 64 is sand paper having a sleeve portion 66 made of "Scotchbrite" material. The present invention contemplates various types of sleeve portions 66 with various types of surfaces used in grinding, honing, deburring, polishing, buffing, sanding, finishing, and other types of surface preparation.

Figure 6A:
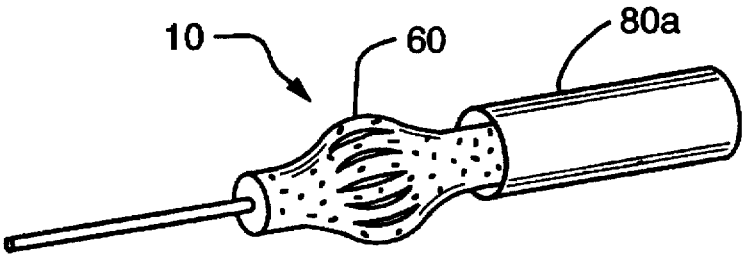
FIGS. 6A–6C are perspective views of various methods of using an inflatable tool to abrade or finish a surface of a workpiece according to the present invention.
Figure 6B:
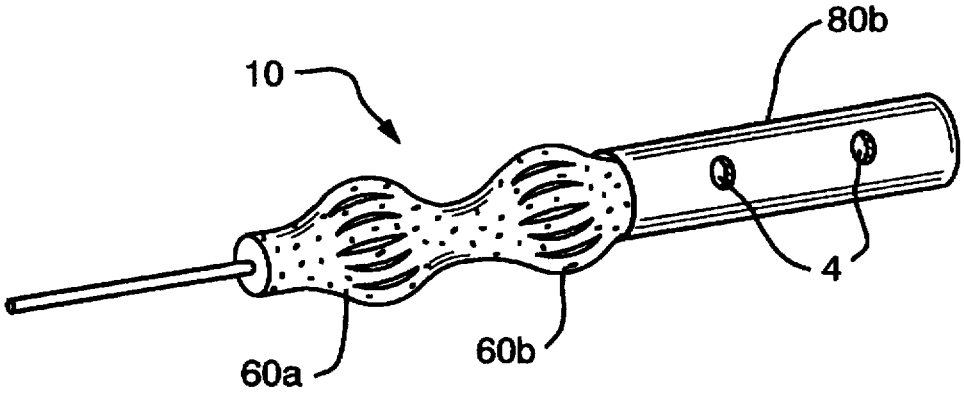
Figure 6C:
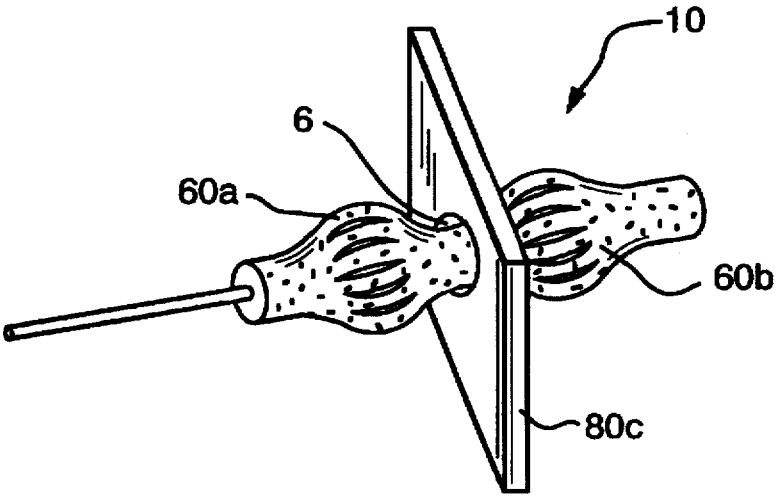

One application for the inflatable tool 10, FIGS. 6A–6C, includes abrading or finishing an internal or external surface of a workpiece **80*a*–80*c*. The one or more bulging abrasive regions 60*a*, 60*b* are easily compressed and expanded so that the inflatable tool 10** conforms to and applies pressure to the surface to be abraded or finished.

One method of using the inflatable tool 10, FIG. 6A, includes using the bulging abrasive region 60 to debur and chamfer a workpiece **80*a*, such as tubing. The inflatable tool 10 having the bulging abrasive region 60 can also be used to sand the interior surface of the workpiece or tubing 80*a* to a desired finish. In one particular example, the inflatable tool 10 is rotated at approximately 1000 to 3000 R.P.M., and the bulging abrasive region 60** is inflated from about 1/16" to 1"

larger than the inside diameter of the workpiece 80*a*. The abrasive on the bulging abrasive region 60 can range from coarse to fine grit depending upon the desired finish. The speed of rotation and the amount of inflation of the inflatable tool according to this method will vary depending upon the size of the tool and the particular workpiece.

According to another method, the inflatable tool 10, FIG. 6B, is used to debur an internal surface of a workpiece 80*b*, such as tubing, in which one or more perpendicular holes 4 have been drilled. An inflatable tool 10 having one or more bulging abrasive regions 60*a*, 60*b* are rotated within the workpiece 80*b* to remove burrs from the intersection of the perpendicular holes 4 and the internal surface of the workpiece 80*b*.

According to a further method, the internal tool 10, FIG. 6C, is used to debur and chamfer both sides of an opening 6 in a workpiece 80*c* simultaneously. In this example, the inflatable tool 10 includes at least two bulging abrasive regions 60*a*, 60*b* and the inflatable tool extends through the hole 6 in the workpiece 80*c* so that the bulging abrasive regions 60*a*, 60*b* are disposed on either side of the workpiece 80*c*. Both sides of the hole 6 can therefore be chamfered in one step without requiring substantial repositioning of the tool or workpiece.

According to this method, the inflatable tool 10 can either be inserted into the hole 6 before inflating or after inflating the inflatable tool. When the inflatable tool 10 is first inflated, one of the bulging abrasive regions 60*a* is compressed when inserted into the hole 6 while the pressurized medium is transferred to the other bulging abrasive region 60*b*. The one or more bulging abrasive regions 60*a*, 60*b* thereby allow the inflatable tool 10 to fit into regions of various shapes and sizes in a workpiece and to conform to and apply substantial pressure against the surface of the workpiece while abrading.

Accordingly, the present invention provides an inflatable tool having a relatively simple, light weight construction that is capable of being manufactured in virtually any size, length, or diameter. The inflatable tool includes an elastomeric outer core portion that provides a resilient or cushioned support surface to prevent damage to the inflatable bladder and abrasive sleeve. The present invention also provides an inflatable tool with one or more bulging abrasive regions that can be used for a variety of abrading or machining applications and for a variety of sizes and shapes of workpieces. Finally, the present invention provides a method of abrading or machining surfaces of a workpiece and particularly, relatively small internal diameters.

Modifications and substitutions by one of ordinary skill in the art are considered to be within the scope of the present invention which is not to be limited except by the claims which follow.

What is claimed is:

1. An inflatable tool, comprising:

a core having a first core end and a second core end, said core including an inner core portion and an elastomeric outer core portion disposed over said inner core portion; and an inflatable bladder disposed over said elastomeric outer core portion and sealably fixed to said core at said first core end and said second core end, said inflatable bladder forming a chamber between said inflatable bladder and said elastomeric outer core portion in an inflated state, wherein said elastomeric outer core portion provides a resilient support surface for said inflatable bladder.

2. The inflatable tool of claim 1, further including a first end clamping plate, for sealably clamping said inflatable bladder to said first core end, and a second end clamping plate, for sealably clamping said inflatable bladder to said second core end.

3. The inflatable tool of claim 2, wherein each of said first end clamping plate and said second end clamping plate include an angled clamping region against which respective first and second ends of said inflatable bladder are clamped.

4. The inflatable tool of claim 2, further including first and second threaded engaging members, for threading into said inner core portion of said core, and for securing said first end clamping plate and said second end clamping plate against first and second ends of said inflatable bladder at said first core end and said second core end respectively.

5. The inflatable tool of claim 1, further including a passageway extending through said inner core portion and said outer elastomeric core portion, for allowing a pressurized medium to pass through said inner core portion and said outer elastomeric core portion into said chamber to inflate said inflatable bladder.

6. The inflatable tool of claim 5, further including a valve operably coupled to said passageway, for controlling the flow of said pressurized medium into and out of said passageway.

7. The inflatable tool of claim 6, wherein a first end of said valve includes a valve passageway, and wherein said first end of said valve is threadably coupled within said inner core portion such that said valve passageway is in fluid communication with said passageway in said core.

8. The inflatable tool of claim 7, wherein a second end of said valve includes a coupling region, for coupling to an inflating device.

9. The inflatable tool of claim 1, wherein said inflatable bladder includes a rubber bladder.

10. The inflatable tool of claim 9, wherein said rubber bladder is made of a non-molded rubber material.

11. The inflatable tool of claim 1, further including an abrasive sleeve disposed around and secured by said inflatable bladder when said inflatable bladder is in said inflated state.

12. The inflatable tool of claim 11, wherein said abrasive sleeve includes at least one bulging abrasive region.

13. The inflatable tool of claim 11, wherein said abrasive sleeve includes at least one slot extending substantially longitudinally in at least a portion of said abrasive sleeve, wherein said at least one slot allows said inflatable bladder and said at least a portion of said abrasive sleeve to bulge when the inflatable tool is inflated, forming at least one bulging abrasive region.

14. The inflatable tool of claim 1, wherein said inflatable tool is adapted to abrade internal surfaces of a workpiece.

15. The inflatable tool of claim 1, wherein said inflatable bladder lies against said elastomeric outer core portion when in a deflated state.

16. An inflatable tool, comprising:

a core having a first core end and a second core end and having at least one passageway extending through a central region of said core;

a rubber bladder disposed over said core and sealably fixed to said core at said first core end and said second core end, and said rubber bladder forming a chamber between said rubber bladder and said core in an inflated state when a pressurized medium passes through said at least one passageway; and an abrasive sleeve, slidably received on said rubber bladder in a deflated state and secured by said rubber bladder when said rubber bladder is in said inflated state, said abrasive sleeve including at least one slot extending substantially longitudinally in at least a portion of said abrasive sleeve, wherein said rubber bladder causes at least a portion of said abrasive sleeve to bulge proximate said at least one slot, forming at least one bulging abrasive region when the inflatable tool is inflated.

17. The inflatable tool of claim 16, wherein said abrasive sleeve forms said at least one bulging abrasive region in said inflated state.

18. The inflatable tool of claim 17, wherein said abrasive sleeve forms at least two bulging abrasive regions in said inflated state.

19. The inflatable tool of claim 16, wherein said rubber bladder is made from a non-molded rubber material.

20. An abrasive sleeve, for use on an inflatable tool to abrade a surface of a workpiece, said abrasive sleeve comprising:

a sleeve portion, for positioning on the inflatable tool, said sleeve portion including an abrasive region, for abrading the surface of the workpiece; and at least one slot extending substantially longitudinally in at least a portion of said sleeve portion, for allowing said at least a portion of said sleeve portion to bulge when the inflatable tool is inflated, each said at least one slot being substantially straight.

21. The abrasive sleeve of claim 20, wherein said at least one slot includes a series of substantially parallel slots extending substantially longitudinally in said at least a portion of said sleeve portion and circumferentially spaced around said sleeve portion, wherein said series of substantially parallel slots create a bulging abrasive region around said sleeve portion when the inflatable tool is inflated.

22. The abrasive sleeve of claim 20, wherein said at least one slot includes at least a first and second series of substantially parallel slots extending substantially longitudinally in at least a first and second portion of said sleeve portion respectively, wherein said at least a first and second series of slots create at least first and second bulging abrasive regions when the inflatable tool is inflated.

23. The abrasive sleeve of claim 20, wherein said sleeve portion including said abrasive region includes sandpaper.

* * * * *